US010964240B1

(12) United States Patent
Woodall

(10) Patent No.: US 10,964,240 B1
(45) Date of Patent: Mar. 30, 2021

(54) ACCURATE DISPLAY PANEL CALIBRATION WITH COMMON COLOR SPACE CIRCUITRY

(71) Applicant: PIXELWORKS, INC., Portland, OR (US)

(72) Inventor: Neil Woodall, Newport Beach, CA (US)

(73) Assignee: Pixelworks, Inc., Portland, OR (US)

( * ) Notice: Subject to any disclaimer, the term of this patent is extended or adjusted under 35 U.S.C. 154(b) by 0 days.

(21) Appl. No.: 16/661,221

(22) Filed: Oct. 23, 2019

(51) Int. Cl.
*G09G 3/00* (2006.01)
*G09G 5/06* (2006.01)

(52) U.S. Cl.
CPC ..... *G09G 3/006* (2013.01); *G09G 5/06* (2013.01); *G09G 2320/0214* (2013.01); *G09G 2320/0242* (2013.01); *G09G 2320/0276* (2013.01); *G09G 2320/0693* (2013.01); *G09G 2340/06* (2013.01)

(58) Field of Classification Search
CPC ..... G09G 2340/06; G09G 2320/0693; G09G 2320/0209–0214; G09G 3/006; G09G 2320/0276; G09G 2320/0242; G09G 5/02; G09G 5/06; G09G 2360/16; H04N 9/69
See application file for complete search history.

(56) References Cited

U.S. PATENT DOCUMENTS

2005/0275668 A1* 12/2005 Feng ..... G09G 3/3611 345/694
2007/0052735 A1* 3/2007 Chou ..... G09G 3/2003 345/690
2008/0218508 A1* 9/2008 Pearman ..... H04N 9/68 345/419
2010/0128050 A1* 5/2010 Chou ..... G09G 3/3607 345/589
(Continued)

*Primary Examiner* — Sanjiv D. Patel
(74) *Attorney, Agent, or Firm* — Miller Nash Graham & Dunn LLP

(57) ABSTRACT

A method of calibrating a display panel includes making measurements of color components produced by the display panel, receiving an input image signal consisting of one or more pixel represented by input color component values, applying a first non-linear transform to the input color component values of the pixel to produce transformed color component values, wherein the first non-linear transform is either based upon the measurements and the panel design or a ratio of values of color components based upon the measurements, applying a crosstalk correction transform to the transformed color component values to produce crosstalk corrected color component values, applying a second non-linear transform to the crosstalk corrected color component values to produce final color component values, and sending the final color component values to the display panel. A method of calibrating a display panel, includes making measurements of color components displayed on the display panel, using the measurements to generate at least one non-linear crosstalk correction transform, receiving an
(Continued)

input image signal consisting of one or more pixel represented by input color component values, changing parameters used in the at least one crosstalk correction transform based upon a current of the panel, and applying one of the at least one crosstalk correction transform having parameters that are a closest fit to the measurements.

17 Claims, 9 Drawing Sheets

(56) References Cited

U.S. PATENT DOCUMENTS

| | | | | |
|---|---|---|---|---|
| 2010/0265266 | A1* | 10/2010 | Liu | G09G 5/02 345/600 |
| 2014/0071177 | A1* | 3/2014 | Chu | H04N 1/6058 345/690 |
| 2014/0333797 | A1* | 11/2014 | Kim | G09G 5/02 348/223.1 |
| 2015/0317944 | A1* | 11/2015 | Safaee-Rad | G09G 3/20 345/595 |
| 2017/0140556 | A1* | 5/2017 | Safaee-Rad | G06T 11/001 |
| 2017/0162144 | A1* | 6/2017 | Chen | G09G 3/3648 |
| 2020/0035173 | A1* | 1/2020 | Kim | G09G 3/3688 |

* cited by examiner

ACCURATE DISPLAY PANEL CALIBRATION WITH COMMON COLOR SPACE CIRCUITRY

BACKGROUND

Display calibration has historically required either complex circuitry to perform or resulted in large errors. As people rely more on the color accuracy of the display to make decisions, display manufacturers have implemented per unit display calibration on the factory floor. The current state-of-the-art for display calibration hardware is to use a three-dimensional look up table (3D LUT) to store the corrections. The display manufacturer measures several different colors, generates the entries for the 3D LUT and then programs it. The number of measurements can be as few as a couple of dozen and as high as thousands depending on the sophistication of the algorithm used to generate the entries in the 3D LUT. Other methods such as polynomial color space converters can be difficult to program and do not provide as accurate results.

Modern displays, whether they are LCD based or OLED require a conversion of the input values that represents the desired color to the voltages or currents required to generate the desired optical output at the pixel. The Display Driver IC (DDIC) typically handles this process, referred to as Electro-Optical Transfer Function (EOTF), as part of the digital to analog conversion process. This non-linear process is designed to provide the correct response at the individual sub pixel level and to create a gamma response to the input similar to a cathode-ray tube (CRT) which has historically been assumed in color standards. A sub pixel represents how the display reproduces just one of the color components that make up the color for a pixel. For example, a pixel usually has a red, green and blue color sub pixel for each pixel to produce the corresponding color components. However, this is not always the case. Sometimes a pixel has only two color components with adjacent pixels having different combinations. For example, OLED displays can have a red-green pixel and a blue-green pixel. Other displays might also provide a white sub pixel in addition to the red, green and blue sub pixels. Regardless of the pixel configuration, the DDIC provides the appropriate driving voltage.

In an ideal world, the output of a sub-pixel would be independent of the content of the other sub pixels in the pixel, and other pixels in the display. That is, the amount of red measured for a pixel would only depend on the value of the red component of the color being transmitted to the red sub pixel. Unfortunately, this is not the case, and this is why displays require complex circuitry to calibrate. For example, in an LCD display you might get leakage from the liquid crystal shutter behind the green subpixel on the color filter through the red portion of the color filter for that pixel. That would result in the amount of red being measured being larger when displaying yellow than just red. For OLED's, the circuitry that determines the brightness of the sub pixel can be influenced by the overall brightness of the screen. This results in a pure red display having a brighter red component than when white is being shown. These errors are referred to as cross-talk and requires a process referred to as cross-talk correction.

A method to calibrate displays with simpler circuitry and more accurate color space conversion and cross-talk correction without added circuitry to keep costs down.

DETAILED DESCRIPTION OF THE EMBODIMENTS

Figure 1:
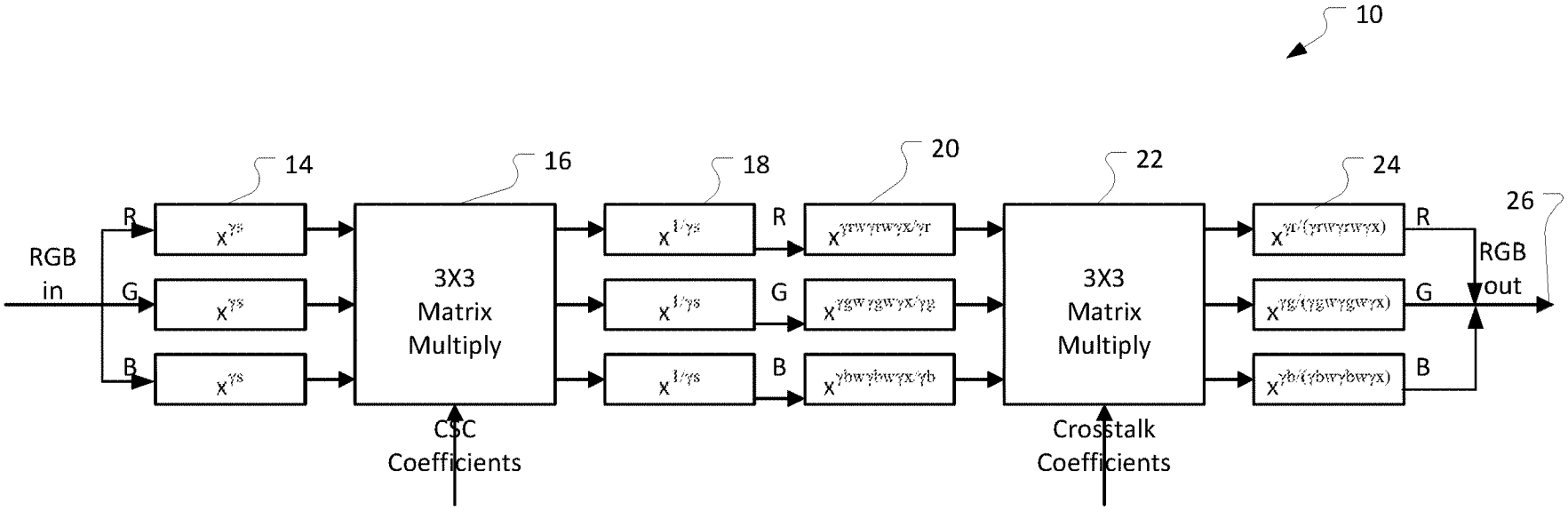
FIG. 1 shows an embodiment of a combination of a color space conversion and crosstalk correction on a video signal.

Some of the embodiments here involve transforming an input signal with a non-linear function to apply color space conversion, then transforming that signal with a different non-linear function to apply cross-talk correction. Finally the data is transformed by an inverse of the panel's Electrical to Optical Transfer Function (EOTF) before being sent to the display.

Other embodiments only apply a cross-talk correction, but have the parameters of that correction change based upon a summary statistic of the panel referred to as the Adjusted Average Picture Level (AAPL). In some embodiments, measurements of the color components displayed on the panel are used to generate non-linear models that have the best fit of the parameters of the non-linear model to the measured data, instead of simply interpolating between the measured data points. The measured data may be transformed in addition to the input signal transformations to account for differences between the measurement environment and the final product environment.

Much of the below discussion will refer to "color components." It should be noted that color components are not a single wavelength, but a distribution of wavelengths. Part of the color calibration process is to determine not only the main wavelength of the color component, but also the purity of the color component. This is summarized in the xy chromaticity coordinates of the color. The xy coordinates are normalized XYZ measurements of the displays such that $x+y+z=1$. The XYZ measurements are a device independent description of the color and can be converted to the display RGB values using a 3×3 color conversion matrix multiply. The coefficients for the conversion can be derived from the xy chromaticity coordinates when measuring the red, green and blue values from the display when only one color component is displayed, and white when all 3 color components are displayed.

The discussion below refers to measuring a color component, or the optical output of a subpixel or a group of sub-pixels. The actual measurement may be using the XYZ device independent color, the spectrum of the color or some other description of the color and that is then converted to a value that represents the measurement of the output of the individual color component. This conversion requires the chromaticities for the primary colors and white, values that can be obtained from the XYZ measurements. Therefore, when the discussion refers to measuring the color component, in reality the XYZ color is measured and the optical output of the subpixel, the color component measurement, is calculated.

Furthermore, when referring to a color component, the discussion refers to the less than pure color component of the display, and not a single wavelength, or a color standard defined color. This means that the crosstalk only measures the interaction among sub pixels and other pixels in the display and is not a measure of how pure the colors are or how accurate they are with respect to a color standard. It will be assumed that the input signal has already be converted from the standard RGB values to the display RGB values using the chromaticity measurements before applying the correction for the crosstalk as described in FIG. 1.

FIG. 1 shows a typical color space conversion and cross talk correction circuit 10. The input signal in this case is a Red Green Blue (RGB) signal that has a non-linear gamma function applied to each component such as shown at 14. The color space coefficients (CSC) are applied by a 3×3 matrix multiplier at 16. The resulting inverse gamma functions such as 18 of the color components are then transformed by another non-linear gamma function, such as at 20. The cross talk correction coefficients are applied by a 3×3 matrix multiplier at 22. The resulting converted and corrected components undergo a third non-linear function such as 24, and are then combined for the RGB output signal at 26.

Figure 2:
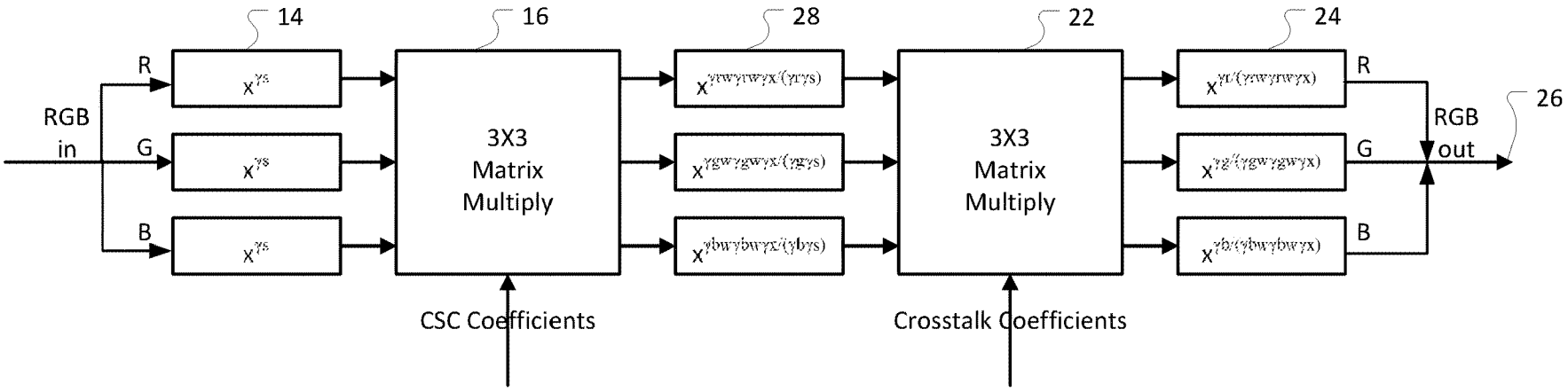
FIG. 2 shows an embodiment of a simplified color space conversion and crosstalk correction process on a video signal.

The circuitry and process of FIG. 1 can be simplified by combining the inverse gamma function 18 of the color space conversion with the gamma function 20 of the crosstalk correction as shown in FIG. 2. In this embodiment, the new function is shown at 28.

In the discussion that follows, a primary color is displayed when only one of the subpixels is illuminated. For an RGB pixel arrangement, the primary colors are Red, Green and Blue. Complementary colors are when only two of the sub pixels are illuminated. That is, red plus green equals yellow, red plus blue equals magenta, and blue plus green equals cyan. Finally, when all the sub pixels are illuminated, they display white or gray. In addition, display calibration is usually done by measuring colors with a fixed window size. The window size can be anything from 1% to 100% of the display area. When measuring with a fixed window size the amount of current used in the display varies based on the color being displayed. This is one reason why the peak amplitude and electro-optical transfer function (EOTF) of the panel changes based on the color. The first part of the discussion below will describe how calibration can be done using a fixed window size measurement, the second part will then modify the approach to dynamically change the parameters based on the amount of panel current. While the discussion describes the embodiments by using the term gamma to make the description easier to follow, any non-linear function could be used as long as it accurately describes the response of the display.

One important factor in simplifying the calibration is that even though the peak brightness and the response of the signal is changing, the signal can still be accurately described using a gamma function. A gamma function, or gamma correction function, maps luminance levels to compensate the non-linear luminance effect of display devices, where gamma, $\gamma$, is a constant and x in the input value. The signal can be described using the relationship $p=ax^{\gamma}$, where p is the output in terms of photons and a is an amplitude. The a's and $\gamma$'s change based on the amount of content being displayed both at the sub pixel and the overall display. If one wants the same amount of a color component when the display displays a primary color versus white in the same size window, then the following relationship exists:

$$p_o=x_w^{\gamma w}=a_c x_c^{\gamma c};$$

where the w subscript designates a white color and the c subscript designates a primary color component. In some of the below discussion, when more than one gammas for the color components are used, they will be identified with subscripts r, g, and b. For most OLED displays, $a_c>1$ and $\gamma_w<\gamma_c$.

However, there is only one input regardless of what color is being displayed which should equal the input required for white, $x_w$, therefore the above equation needs to be rewritten and $g_a$ and $y_a$ found where the following is true for all $x_w$. The entity $g_a$ is a gain function.

$$p_o=x_w^{\gamma w}=a_c(g_a x_w^{\gamma w\cdot\gamma(a)})^{\gamma c/\gamma w} \tag{3}$$

expanding the left hand side results in:

$$x_w^{\gamma w}=a_c(g_a^{\gamma c/\gamma w})(x_w^{\gamma w\cdot\gamma(a)})^{\gamma c/\gamma w}=a_c(g_a^{\gamma c/\gamma w})(x_w^{\gamma a\cdot\gamma c}) \tag{4}$$

which is only true if $y_a$ is equal to $y_w/y_c$, resulting in the following relationships:

$$1=a_c(g_a^{\gamma c/\gamma w}),\text{ or } g_a=(1/a_c)^{\gamma w/\gamma c} \tag{5}$$

$$p_o=x_w^{\gamma w}=a_c(g_a x_w^{\gamma w\cdot\gamma w/\gamma c})^{\gamma c/\gamma w} \tag{6}$$

Therefore by transforming from a linear color space ($x_w^{\gamma w}$) to a slightly nonlinear color space ($x_w^{\gamma w\cdot\gamma w/\gamma c}$) based on the ratio of the gamma for a given color component, $\gamma_c$, when displaying white, versus the same color component when displaying a primary color, it is possible to correct for the crosstalk caused by changes in the gamma and peak amplitude that vary with the purity of the color by multiplying by a constant. While this applies the crosstalk correction with the correct non-linear response, it will still end up being displayed with the wrong gamma. If the gammas are similar, this is not that big of an error and can usually be ignored. Fixing the response completely requires blending between two different gammas after the conversion and those gammas need to be based on how close the color is to a primary color versus white as will be shown later.

This is the basic equation for the crosstalk calculation used to adjust between a pure color component being displayed and when white is displayed. However, other colors are also possible. If the gammas for the complementary colors that include that color component are measured one can do the same calculation. For example, if one wants the crosstalk for red when displaying both red and green one would need the gamma for yellow (red & green) in addition to red and white. Changing the a subscript to rg (yellow), rr (red) and rw (white) to distinguish from the generic example above we get $$g_{rr}=(1/a_{rr})^{(\gamma rw/\gamma rr)} \tag{7}$$

$$g_{rg}=(1/a_{rg})^{(\gamma rw/\gamma rg)} \tag{8}$$

$$g_{rb}=(1/a_{rb})^{(\gamma rw/\gamma rb)} \tag{9}$$

If one assumes that the crosstalk is additive, one can use these gains in a matrix multiplication. First the process needs to adjust the yellow component so that it becomes the delta between the yellow and the red crosstalk.

$$g'_{rg}=g_{rg}-g_{rr} \tag{10}$$

The process can do the same thing for magenta, which is red and blue components displayed together, and get $$g'_{rb}=g_{rb}-g_{rr} \tag{11}$$

Finally, because the additive mixture is an approximation, and because the process needs to ensure that white value is unchanged because that is the reference point for all of the calculations, the process can normalize the $g_{rr}$, $g'_{rg}$ and $g'_{rb}$ values so that they add up to 1. This is accomplished by dividing each of crosstalk values by the sum of the values. That is $$g''_{rr}=g_{rr}/(g_{rr}+g'_{rg}+g'_{rb}) \tag{12}$$

$$g''_{rg}=g'_{rg}/(g_{rr}+g'_{rg}+g'_{rb}) \tag{13}$$

$$g''_{rb}=g'_{rb}/(g_{rr}+g'_{rg}+g'_{rb}) \tag{13}$$

Then the CSC matrix multiplication implements the following relationships:

$$R'=R*g''_{rr}+G*g''_{rg}+B*g''_{rb}$$

$$G'=R*g''_{gr}+G*g''_{gg}+B*g''_{gb}$$

$$B'=R*g''_{br}+G*g''_{bg}+B*g''_{bb} \tag{14}$$

However, the amount of crosstalk is not always a linear relationship between the amounts of the output of the other color components. For example, in an OLED, the cross talk can arise as the amount of current in each subpixel and total current in the panel impacts the voltage setting accuracy. For a light emitting diode, the relationship is complex, but can be approximated by a gamma curve, $\gamma_x$. Therefore, the process is really interested in $$p'^{\gamma x}_c/p'^{\gamma x}_o=((x_c^{\gamma w})^{\gamma x})/p'^{\gamma x}_o \tag{15}$$

Equation 3 doesn't change in this case and substituting $x_c$ for that results in the cross talk gain:

$$p'^{\gamma x}_c/p'^{\gamma x}_o=((((p_o/a_c)^{(1/\gamma c)})^{\gamma w})^{\gamma x})/p'^{\gamma x}_o \tag{16}$$

Again $p'_o=p_o^{(\gamma w/\gamma c)}$ so that the cross talk is constant results in $$g_a=a_c^{\gamma w\cdot\gamma x/\gamma c} \tag{17}$$

$$p_o=a_c(g_x x_w^{\gamma w\cdot\gamma w\cdot\gamma x/\gamma c})^{\gamma c/(\gamma w\cdot\gamma x)} \tag{18}$$

Figure 3:
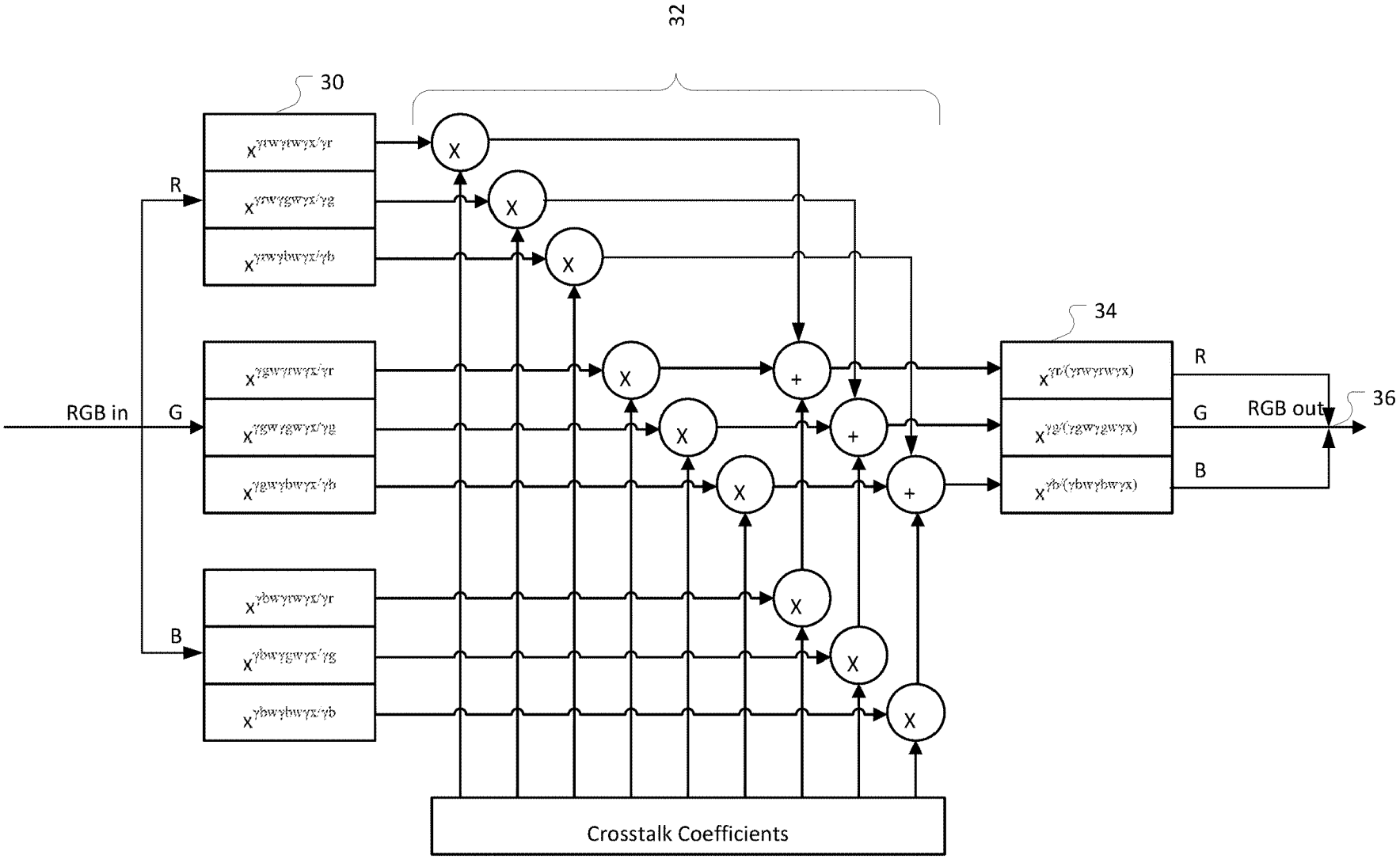
FIG. 3 shows an embodiment of hardware used to calibrate a display panel.

This then allows the hardware shown in FIG. 3 to be used to calibrate the panel. A 1D LUT provides the transform data such as 30 to transform the input components to a non-linear function with gamma approximately equal to $\gamma_x$, a 3×3 matrix multiply shown by 32, and a non-linear function such as 34 to go from the $\gamma_x$ space to the measured gamma of the panel 36. In FIG. 3 at 30, the red input needs to be transformed to linear space. This is the first $\gamma_{rw}$ term. Then it needs to be transformed to the non-linear space for crosstalk correction. But because of the constraint that white remains white, the second white gamma term for the components needs to be the same for a given input. That is, the inputs to calculate the Red output, the terms are $\gamma_{rw}\gamma_x/\gamma_r$, for the green output component the red is transformed by $\gamma_{gw}\gamma_x/\gamma_g$, and for the blue output component by $\gamma_{bw}\gamma_x/\gamma_b$.

Figure 4:
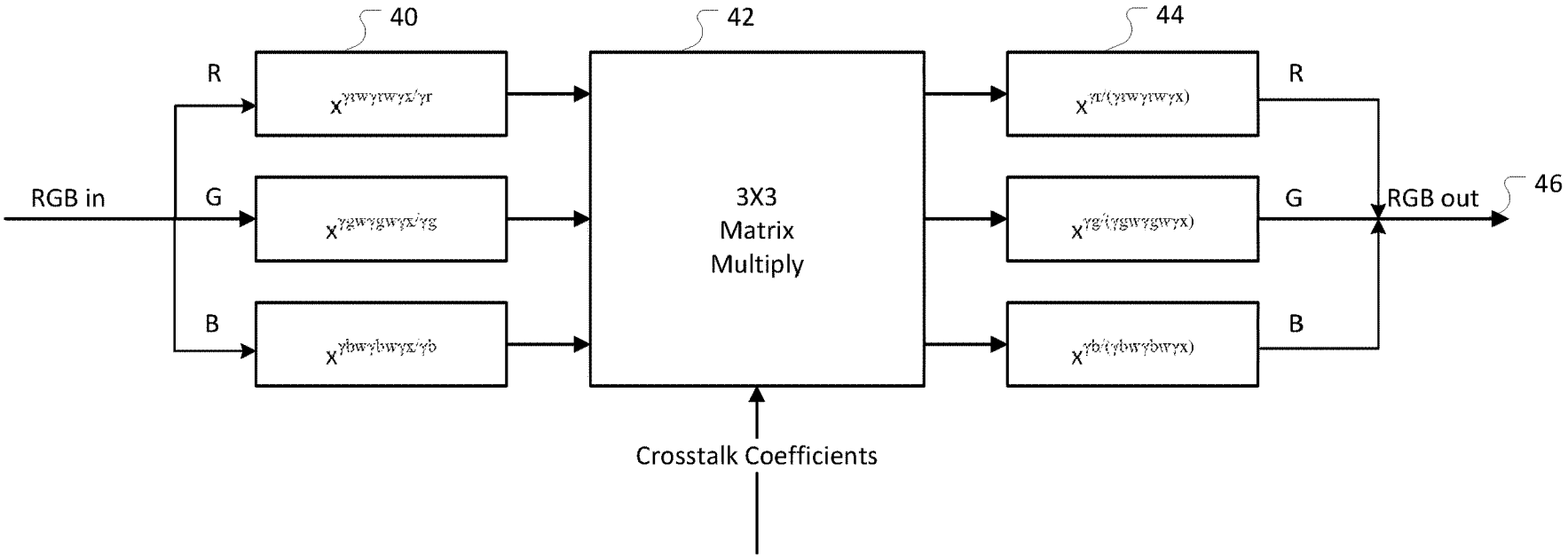
FIG. 4 shows an embodiment of a configuration of hardware used for color space conversion used for crosstalk correction.

Because $\gamma_{rw}\gamma_x/\gamma_r$, $\gamma_{gw}\gamma_x/\gamma_g$ and $\gamma_{bw}\gamma_x/\gamma_b$ are typically close to the same value and the crosstalk coefficients $g''_{rr}$, $g''_{gg}$ and $g''_{bb}$ have a much larger amplitude than the other coefficients, the hardware of FIG. 3 can be simplified to the same configuration of hardware used for color space conversion similar to FIG. 2, as shown in FIG. 4. In FIG. 4, the gamma correction is adjusted to be the color component non-linear function at 40, then the 3×3 matrix multiply at 42, the non-linear function such as 44 to produce the output display data at 46.

Because the assumption that the cross talk is an additive function is only approximate, sometimes better results can be obtained if the crosstalk gamma ($\gamma_x$) used to calculate the crosstalk gains denoted as ($\gamma_{x1}$) is slightly different than the crosstalk gamma ($\gamma_{x2}$) used to transform the color components before the 3×3 matrix multiply.

$$g_a=a_c^{\gamma w\cdot\gamma x1/\gamma c} \tag{19}$$

$$p_o=a_c(g_x x_w^{\gamma w\cdot\gamma w\cdot\gamma x2/\gamma c})^{\gamma c/(\gamma w\cdot\gamma x2)} \tag{20}$$

Finally, as mentioned above, the output gamma response is not quite correct because the process has done nothing to adjust the gamma in the equations above in response to changes in the color. The simplest correction is to do a linear interpolation between a gamma response with the primary color and the gamma response for a white color. Simplifying equation 20 results in $$p_o=a_c(g'_a x_w^{\gamma w}).g'_a=g_a^{\gamma c/(\gamma w\cdot\gamma x2)} \tag{21}$$

where $p_o$ represents the output if the panel had a gamma response of $\gamma_w$, but the response is actually between $\gamma_c$ and $\gamma_w$. Therefore, $p_o$ needs to be converted back to a non-linear response using a value between $1/\gamma_c$ and $1/\gamma_w$ before sending the data to the panel to get the correct response. Because gamma is measured using a pure color and white, and gamma also seems to be related to the average picture level, the function can be approximated by the following (the input signal range is 0-1):

$$\gamma_b=\gamma_c+(\gamma_w-\gamma_c)*(R+G+B-1)/2 \tag{22}$$

Figure 5:
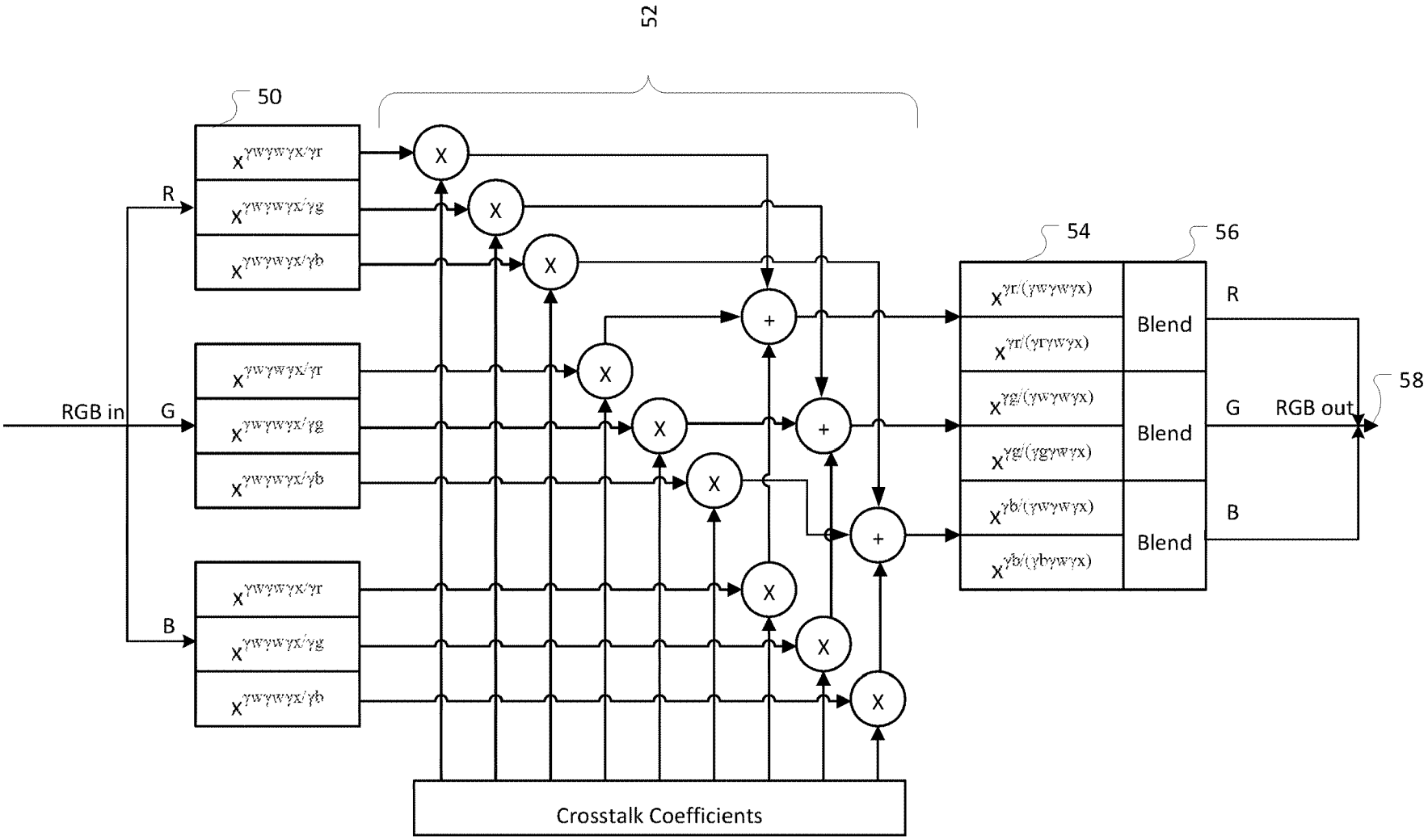
FIG. 5 shows an embodiment of hardware used to calibrate a display panel

Equation 22 can be implemented with an embodiment of circuitry shown in FIG. 5. The non-linear transforms applied, such as 50 and the multiplier and adders in 52 are similar to FIG. 3, as is the second non-linear transform 54. The difference is the gamma blending circuitry 56 that blends the gamma for the pure color and the gamma for the white to arrive at an intermediate gamma. While this provides an accurate result with flat field test patterns, improved accuracy for all content can be obtained by a more complex function, such as the AAPL based blending process described below. However, the above only requires a multiplier and adders to implement the blending logic and is low cost. FIG. 5 shows one embodiment of such hardware.

Up to this point, the discussion has focused on using the fixed window (or average picture level) approach. In this approach, the data undergoes 2 non-linear transforms into and out of the non-linear crosstalk correction space, and the 3×3 matrix multiply with all of the parameters being fixed regardless of the content being displayed.

As mentioned previously, another approach would be to dynamically change the parameters based on an amount of panel current. The amount of current can be estimated by a process similar to calculating the Average Picture Level (APL). To reinforce that it is based on the average content of the scene, but is calculated slightly differently, it will be referred to as the Adjusted Average Picture Level (AAPL). This approach results from the practical impact that the values for $a_c$, $\gamma_c$ and $\gamma_w$ are known to change with the average picture level. The optimal $\gamma_x$ value also changes, but because this gamma value is always combined with another gamma value, it doesn't impact the complexity. If the calibration is to be accurate for all types of content, then the coefficients for the 3×3 matrix multiply need to change as a function of the AAPL along with the 1D LUT that converts the output to the measured gamma of the panel. This is shown in FIG. 6.

Figure 6:
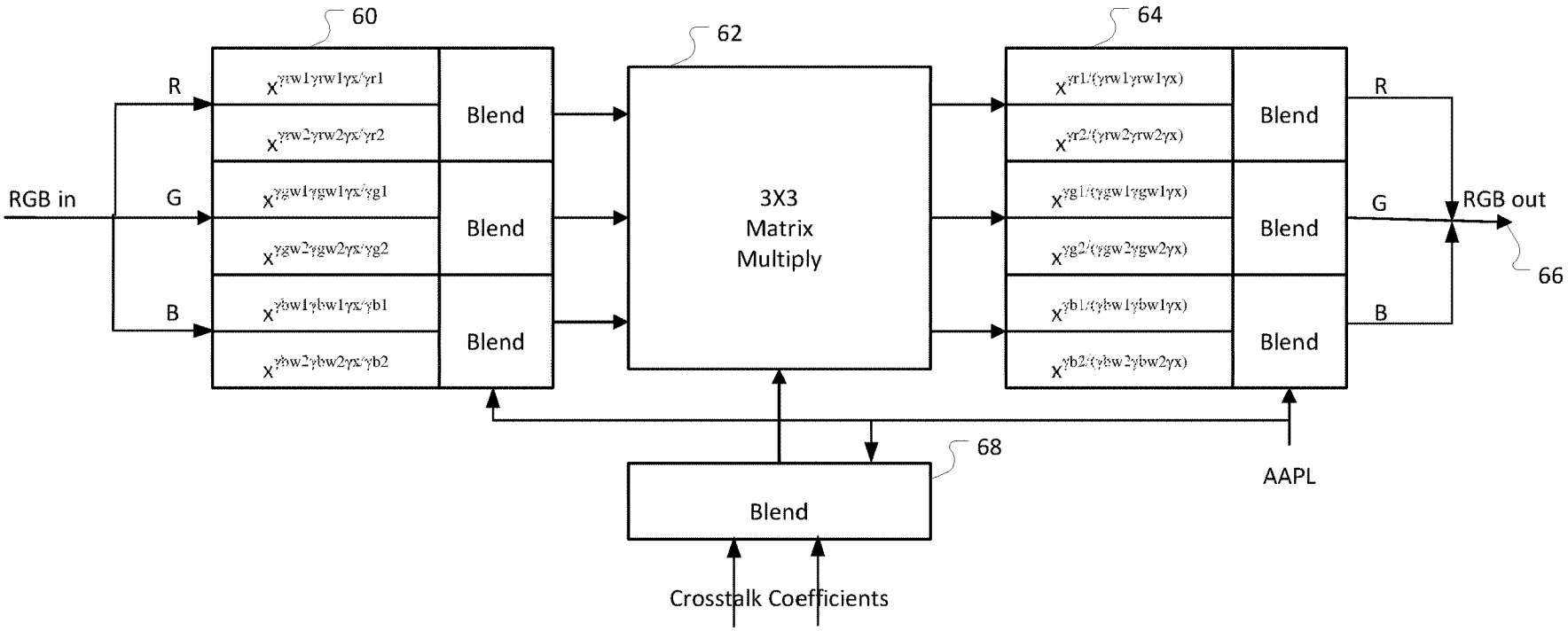
FIG. 6 shows an embodiment of hardware used for an average picture level adjustment.

In FIG. 6, the input component signals have a blended gamma applied that is a blend of the gammas used in FIG. 4, but measured at two different AAPL levels. The gammas based on the first AAPL measurements have "1" added to the subscripts and gammas based on the second AAPL measurements have "2" added to the subscripts. This is shown at 60 just before the 3×3 matrix multiply at 62. The gammas are blended based on some function k(APPL). The inverse gammas are then also blended using the same function k(AAPL) at 64 to generate the output signal at 66. In addition to blending the gammas, the crosstalk coefficients are blended as well at 68. Because the 3×3 matrix multiply must always have a white input (R=G=B) the only possibility is:

Mout=h(AAPL)*M1+(1−h(AAPL))*M2, where M1 and M2 are the 3×3 matrix found using the AAPL 1 and 2 respectively. Note that k(AAPL) is not necessarily equal to h(AAPL). The blended gamma function may result from a blend of all of the pixels in an image frame, or may result from a majority of the pixels in an image frame. That is, the gamma function may be determined from a number of pixels less than the number of pixels in an entire image frame, but usually more than 50% of the pixels.

Figure 7:
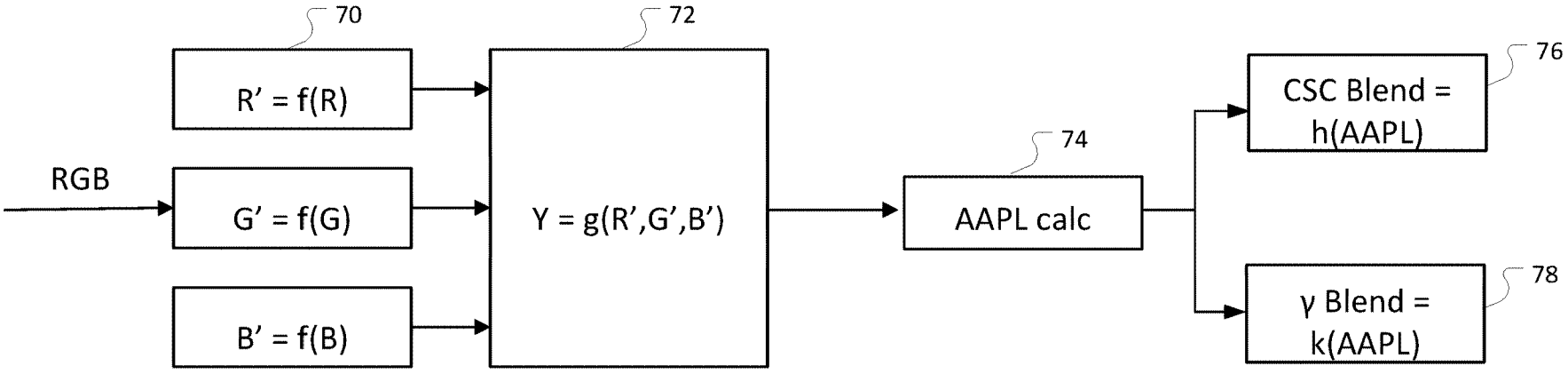
FIG. 7 shows an embodiment of using an adjusted average picture level.

The adjusted average picture level is a proxy for the amount of current and the impact of that current on the crosstalk values. Therefore, when calculating the AAPL a more generalized function than used for the APL can be used for increased accuracy. This will model the impact of the different colors, the different colors requiring a different amount of current for a given luminance output, and the non-linear impact of the color on the cross talk. This is shown in FIG. 7.

Y=f(x) represents mapping the input value to a sub pixel current value for each color component, where R'=f(R), as shown at 70. Whatever the input color value is for the entire pixel is broken into its sub pixel values for each component and those values result in some amount of current being applied to the display. This mapping connects the sub pixel color component value to the current applied to achieve that value.

Y=g(x) represents mapping the sub pixel current to a pixel current value at 72. This takes the sub pixel current for each color component and map that current to the overall pixel current value. This is usually just the sum of the individual sub pixel currents, but some cross talk is possible at this point. For example, inductive or capacitive coupling between the traces in the panel used for setting a current or voltage value at an individual sub pixel could result in the total current for white being different than what would be expected by the sum of the pixel currents when displaying the primary colors.

At 76, the pixel currents are summed together to get the total current in the panel. The crosstalk coefficients are blended at 76 at h(AAPL), and the gammas are blended at 78, k(AAPL).

Most of the hardware is not included with typical SOC (system on a chip) product in most displays and would require custom circuitry to implement. But a lot of products do have some type of average picture level (APL) function. Even if the included APL does not sum the color values based on a value proportional to the current required, it will be close enough to provide an improvement for most image content. The final functions h(APL) and k(APL) can be implemented in software, using the APL circuitry, because it only changes once/frame. For example, typical hardware may only calculate the average R ($APL_R$), the average G ($APL_G$) and the average B ($APL_B$) values. The software would need to combine those values together and then calculate a blending percentage, something easily accomplished between frames.

Figure 8:
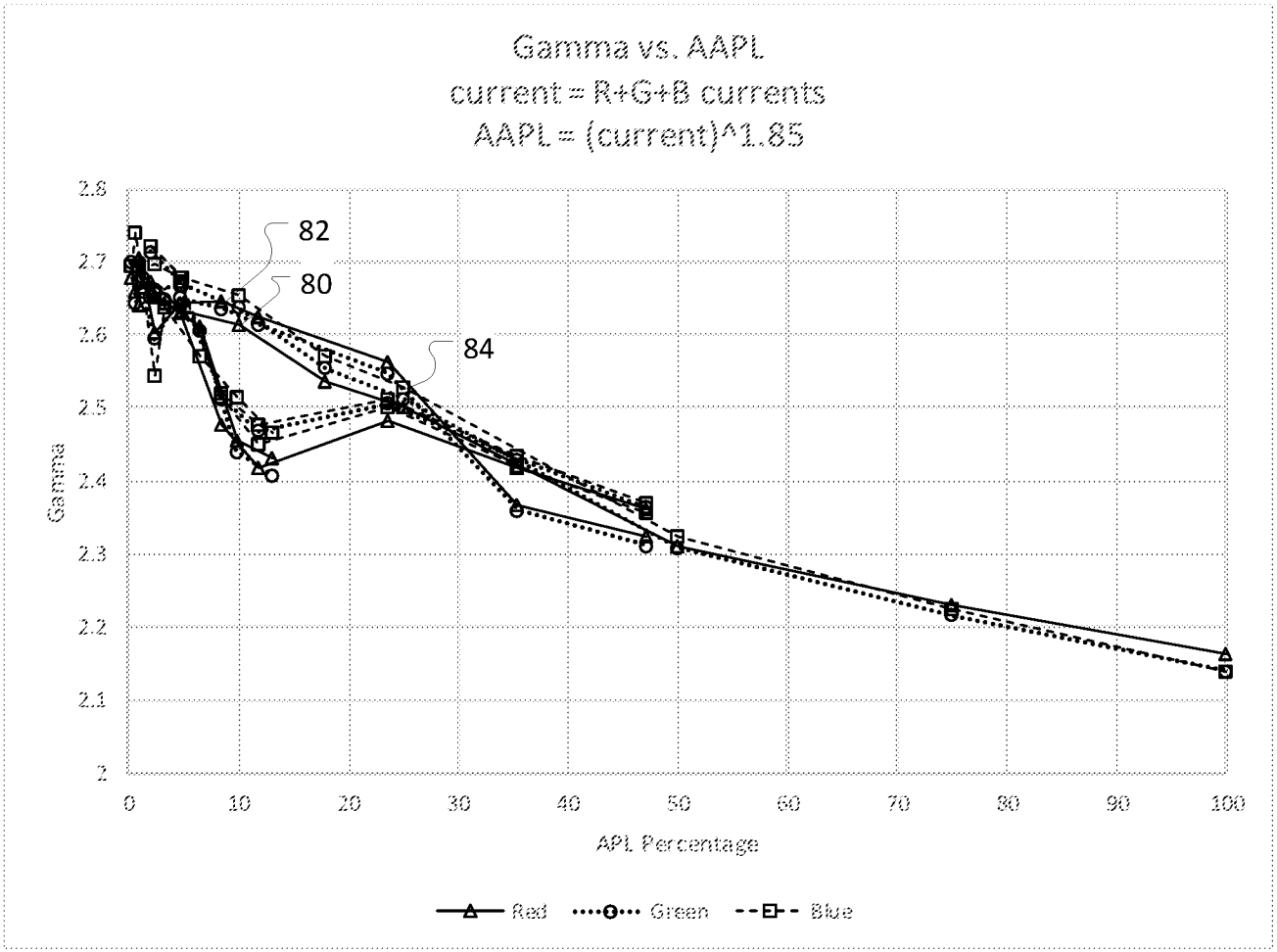
FIG. 8 shows a graph of an example measurement.

Finally, in a lot of cases, the differences between the gammas for the primary color, complementary colors, and white is the simply the result of differences in the AAPL. If the AAPL is calculated correctly, the gamma for a given color component should be independent of what the other colors are. FIG. 8 shows an example measurement where $g(x)=(APL_R+APL_G+APL_B)^{1.8}$. The primary color AAPLs, as red 80, green 82, and blue 84, go from 0 to 15, the complementary color AAPLs go from 0 to 50, which are combinations of two of the primary colors, and the white AAPLs, the combination of all three, go from 0 to 100.

Figure 9:
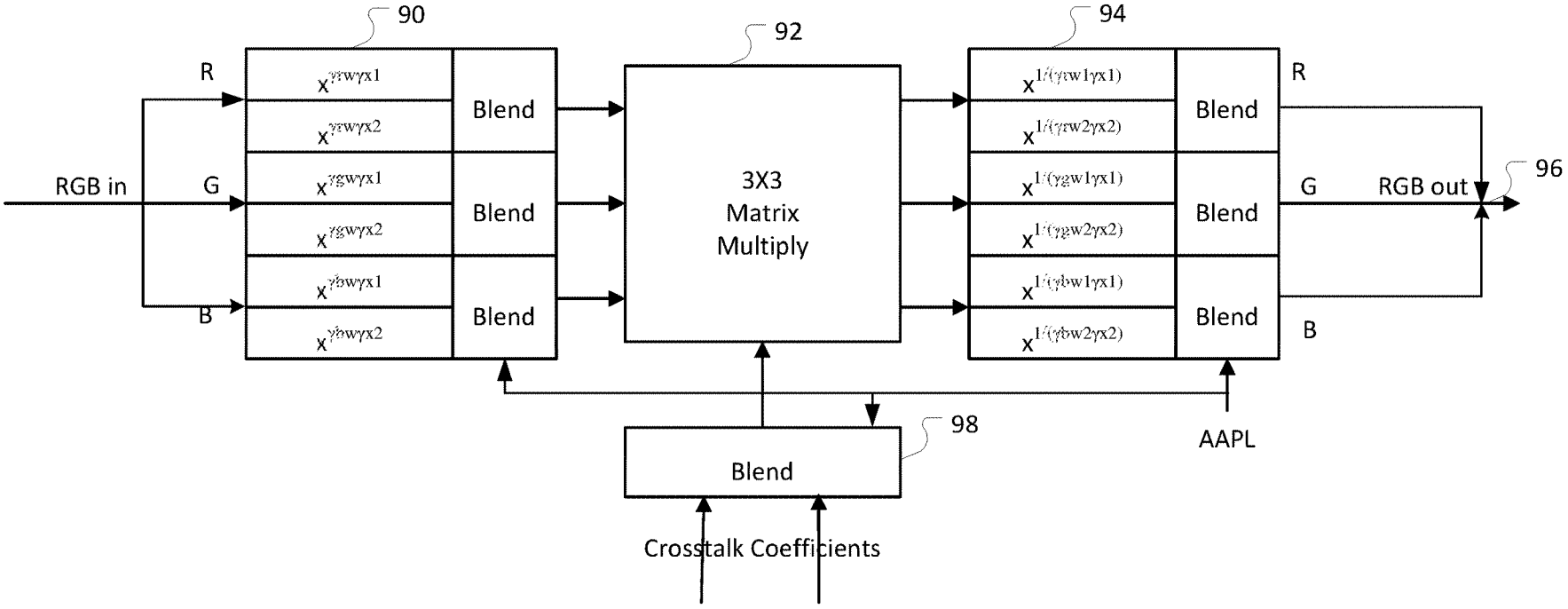
FIG. 9 shows an embodiment of a simplified adjusted average picture level process.

In that case, it is possible to further simplify things as shown in FIG. 9. At 90, FIG. 9 shows the measurement of a single gamma for white for each color component multiplied by the crosstalk gamma. The color component gammas are measured for a max and min APL for each panel and the crosstalk gammas chosen to minimize the total errors and stay the same for a given panel technology. After the crosstalk correction multiply at 92, the output 96 is generated after applying the inverse of the input gammas at 94.

The basis of the non-linear transforms used above, and the adjustments in the AAPL dynamic adjustment lies in measuring the color components. Accurate color calibration requires the correction of both the color crosstalk and deviations from the ideal input to current (or voltage) transform in the DDIC. For the latter, one series of gray values is required to map those deviations. Then, for each AAPL level for which accurate color calibration is required, the 6 primary and complementary colors at max output and a mid-level value are required. This allows the calculation of the $\gamma_c$'s and $a_c$'s. Next, for a given panel design, the $\gamma_x$ value needs to be found that minimizes the errors after calibration. The panel design includes, but is not limited to: technology such as OLED or LCD, the sub pixel layout, the traces on the panel, the resolution or pixel density, etc. These are characteristics that are not expected to change on a per unit basis. Currently finding $\gamma_x$ is done by trial and error.

For calibration at a single AAPL level, a total of 21 measurements provides calibration accuracy the equivalent of other methods making close to 100. Note, while using a gamma function to model the non-linearities appears to be the most efficient method because it only requires two measurements to find the gamma parameter, higher accuracy may be possible with more complex non-linear functions that more closely mimic the underlying cause of the crosstalk.

When finding values for the AAPL adjusted method, one embodiment uses a test pattern that keeps the AAPL level for each individual color the same. This means that if you are displaying a primary color in the window, then the background is the opposite complementary color. For example, if the window is red, then the background would be cyan (green plus blue). Furthermore, if the gamma values are the same for primary, complementary and white colors, then it is only necessary to measure the white values and the 3 max primary values to calculate the necessary parameters for the color space conversion and crosstalk correction. This is because only the CSC values and the gammas calculated for a gray scale will be changing as a function of the AAPL.

Depending on the panel technology and manufacturing tolerances it may be possible to do a subset of the measurements. The first reduction in the measurements would be to eliminate the measurement of the complementary colors and estimate those values based on the measurements of the primary colors and white. For example, the complementary color values could be derived as a weighted sum of white and the primary color measurements that are common to the two complementary colors used to calculate the crosstalk correction for the subpixel of the same primary color.

$$\gamma_{rg}=w1*\gamma_{rr}+w3*\gamma_{rw} \quad (21)$$

$$\gamma_{rb}=w4*\gamma_{rr}+w6*\gamma_{rw} \quad (22)$$

or it could the weighted sum of the two primary colors used to create a complementary color and white.

$$\gamma_{rg}=w1*\gamma_{rr}+w2*\gamma_{gg}+w3*\gamma_{rw} \quad (23)$$

$$\gamma_{rb}=w4*\gamma_{rr}+w5*\gamma_{bb}+w6*\gamma_{rw} \quad (24)$$

As shown above, if the gamma is adjusted based on the measured AAPL, it may be enough to measure the gamma for the white test pattern only.

In general, the complementary color values could be calculated based on a model using the three primary colors and white. The values in the model are found by measuring several panels and performing a regression analysis fit to the model to the data.

From a practical standpoint, the measurements on the factory floor do not match the conditions of the final product. For example, the factory floor measurements might be done with a protective film attached, before the touch screen is attached, and in a test jig instead of the final product. This causes the measurements to shift because of changes to the optical path, temperature and warm up time. Therefore, the measurements made above need to be transformed to what the measurements will be in the final product. This is done by measuring several panels both before and after assembly. A regression analysis is performed and the results used to transform the measured factory floor values to values that will be used for calibration.

Finally, while the display component is manufactured to a specification, the specification allows significantly more variation in the display panel measurements than what is typically found in production. The variation within a batch of panels is even less. Therefore, to save cost a manufacturer may measure a sample of panels and base the correction factors on those measurements.

In all cases, the measurements obtained are used to estimate the variation in peak luminance output and gamma (or other non-linear function) for the 3 primary colors, 3 complementary colors and white. From this data it is possible to calculate the crosstalk correction matrix that provides accurate calibration for all the colors.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of calibrating a display panel, comprising:

making measurements of color components produced by the display panel;

receiving an input image signal consisting of one or more pixel represented by input color component values;

applying a first non-linear transform to the input color component values of the pixel to produce transformed color component values representative of output color components in a non-linear color space based upon the panel design;

applying a crosstalk correction transform based upon the measurements and the non-linear color space to the transformed color component values to produce crosstalk corrected color component values;

applying a second non-linear transform to the crosstalk corrected color component values to produce final color component values; and sending the final color component values to the display panel.

2. The method as claimed in claim 1, wherein making measurements comprises making measurements of each color component when each color is displayed, of each color component when other colors are displayed, and of each color component when white is displayed.

3. The method as claimed in claim 1, wherein the first non-linear transform comprises at least one non-linear function determined for each color component when the pixel is displaying white.

4. The method as claimed in claim 3, wherein the at least one non-linear function comprises a gamma function.

5. The method as claimed in claim 4, wherein the at least one gamma function comprises one gamma function and the one gamma function includes a gamma function for each color component determined when white is displayed, a gamma function for a complete pixel value, and a gamma function for each color component when the color component is displayed.

6. The method as claimed in claim 4, wherein the gamma function for each color are estimated from at least two other measurements.

7. The method as claimed in claim 4, wherein the at least one gamma function for each color component comprises a blended gamma function of two gamma functions for each color component.

8. The method as claimed in claim 7, wherein the blending is controlled by a current pixel value.

9. The method as claimed in claim 7, wherein the blending is controlled by a value determined by the measurement of a majority of pixels in one or more frames.

10. The method as claimed in claim 1, wherein the crosstalk correction transform comprises a matrix multiplication.

11. The method as claimed in claim 1, wherein the second non-linear transform is based on a measurement of the panel EOTF.

12. The method as claimed in claim 1, further comprising storing values for the non-linear transforms in a one-dimensional look up table.

13. A method of calibrating a display panel, comprising:

making measurements of color components for groups of sub-pixels of a same color component displayed on the display panel;

using the measurements to generate at least one non-linear crosstalk correction transform;

receiving an input image signal consisting of one or more pixel represented by input color component values;

changing parameters used in the at least one crosstalk correction transform based upon a current of the panel, estimated by an adjusted average picture level;

applying one of the at least one crosstalk correction transform having parameters that are a closest fit to the measurements.

14. A method of calibrating a display panel, comprising:

making measurements of color components produced by the display panel;

receiving an input image signal consisting of one or more pixel represented by input color component values;

applying a first non-linear transform to the input color component values of the pixel to produce transformed color component values representative of output color components in a non-linear color space based upon a panel design;

applying a non-linear crosstalk correction transform to the transformed color component values to produce crosstalk corrected color component values, wherein the non-linear crosstalk correction transform is based upon a ratio of values of color components based upon the measurements;

applying a second non-linear transform to the crosstalk corrected color component values to produce final color component values; and sending the final color component values to the display panel.

15. The method as claimed in claim 14, wherein the ratio of values is based upon the measurements made when displaying white and when displaying a primary color.

16. The method as claimed in claim 14, wherein the ratio of values is based upon the measurements made when displaying more than one primary color and when displaying white.

17. The method as claimed in claim 1, wherein applying a first non-linear transform to the input color component values of the pixel to produce transformed color component values representative of output color components in a non-linear color space is also based upon the panel design.

* * * * *